United States Patent [19]

Yoshimoto

[11] 4,392,659

[45] Jul. 12, 1983

[54] TWO-WHEELED ROLLER SKATE

[75] Inventor: Koichi Yoshimoto, Kobe, Japan

[73] Assignee: Hanshin Sogyo Co., Ltd., Osaku, Japan

[21] Appl. No.: 234,895

[22] Filed: Feb. 17, 1981

[30] Foreign Application Priority Data

Nov. 25, 1980 [JP] Japan ..... 55-168513[U]

[51] Int. Cl.[3] ..... A63C 17/06

[52] U.S. Cl. ..... 280/11.23; 280/11.28

[58] Field of Search ..... 280/11.23, 11.22, 11.27, 280/11.137, 11.115, 11.28, 11.19

[56] References Cited

U.S. PATENT DOCUMENTS

| | | | |
|---|---|---|---|
| 1,771,855 | 7/1930 | MacMillan | 280/11.23 |
| 2,025,858 | 12/1935 | Harris | 280/11.28 |
| 2,137,330 | 11/1938 | Brazel | 280/11.26 |
| 2,259,346 | 10/1941 | Long | 280/11.23 |
| 2,719,725 | 10/1955 | Ware | 280/11.28 |
| 3,339,936 | 9/1967 | Hamlin | 280/11.23 |
| 3,877,710 | 4/1975 | Nyitrai | 280/11.23 |
| 4,212,479 | 7/1980 | Yoshimoto | 280/11.28 |

FOREIGN PATENT DOCUMENTS

| | | | |
|---|---|---|---|
| 654100 | 12/1937 | Fed. Rep. of Germany | 280/11.23 |
| 410240 | 3/1910 | France | 280/11.23 |

*Primary Examiner*—David M. Mitchell

*Attorney, Agent, or Firm*—Bernard, Rothwell & Brown

[57] ABSTRACT

A two-wheeled roller skate comprising (a) a base plate adapted to be mounted on a shoe base; and (b) a pair of suspension arms each having one end resiliently connected to said base plate, a bent portion resiliently and more or less rotatably supported by said base plate and a free end rotatably supporting one roller.

1 Claim, 8 Drawing Figures

TWO-WHEELED ROLLER SKATE

BACKGROUND OF THE INVENTION

1. Field of the Invention

This invention relates to roller skates and more particularly to an improvement on or relating to a two-wheeled roller skate.

2. Description of the Prior Art

Roller skates with four rollers for moving on smooth surfaces have heretofore been well known. Such roller skates, however, require a number of parts and are complex in construction. In addition, the conventional four-wheeled roller skate could not obtain a gliding movement and feeling which is similar to that of the ice skate. Moreover, the use of the conventional four-wheeled roller skate provides the drawbacks that a skater receives a sudden shock owing to constructional reasons when the inclination of the ground surface on which he glides becomes changed and when the skater tends to suddenly change his gliding direction and that the roller skate is not durable.

SUMMARY OF THE INVENTION

An object of the invention, therefore, is to provide a two-wheeled roller skate which can eliminate the above mentioned various drawbacks which have been encountered with the above mentioned conventional roller skate.

Another object of the invention is to provide a two-wheeled roller skate which can obtain a sliding movement and feeling which is similar to that of the ice skate.

A further object of the invention is to provide a two-wheeled roller skate which can effectively alleviate a shock to which a skater tends to be subjected when he is gliding.

A still further object of the invention is to provide a two-wheeled roller skate which is simple in construction and has an excellent durability.

A feature of the invention is the provision of a two-wheeled roller skate comprising (a) a base plate adapted to be mounted on a shoe base; and (b) a pair of suspension arms each having one end resiliently connected to said base plate, a bent portion resiliently and more or less rotatably supported by said base plate and a free end rotatably supporting one roller.

Further objects and features of the invention will be fully understood from the following detailed description with reference to the accompanying drawings, wherein:

DETAILED DESCRIPTION OF PREFERRED EMBODIMENTS

Figure 1:
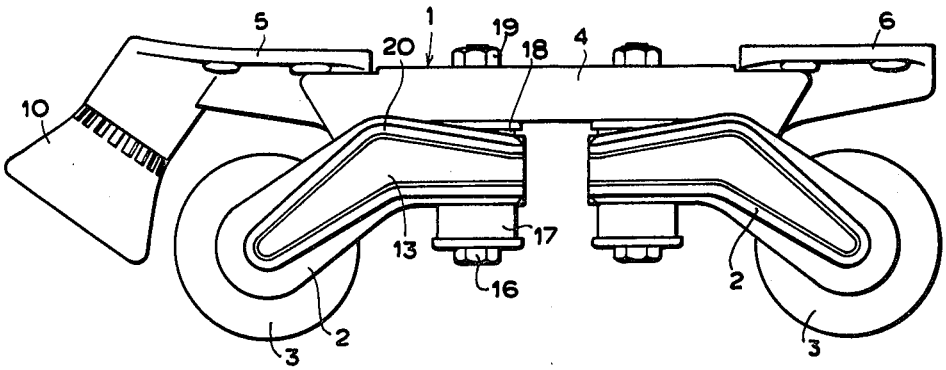
FIG. 1 is a side elevational view of one embodiment of a two-wheeled roller skate according to the invention.

The embodiments of the invention will now be described with reference to the accompanying drawings, in which same or similar parts are denoted by the same reference numerals.

The roller skate according to the invention is composed of a base plate 1 on which is disposed a skater's foot, a pair of suspension arms 2 resiliently connected to the base plate 1 and one roller 3 rotatably supported by the free end of suspension arm 2.

Figure 4:
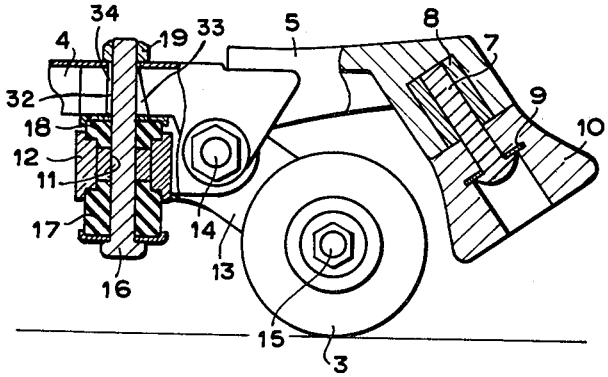
FIG. 4 is a side elevational view of essential parts of the roller skate shown in FIG. 1, partly shown in section.

The base plate 1 is composed of a horizontally extending bridge portion 4 provided at its two ends with toe base portion 5 and heel base portion 6 secured thereto, respectively. These toe base portion 5 and heel base portion 6 function to support the skater's toe and heel disposed thereon, respectively. As shown in FIGS. 1 and 4, to the toe base portion 5 is firmly secured a stopper 10 through a stopper bolt 7, stopper insert nut 8 and stopper insert washer 9. The stopper 10 functions as a brake used to stop the gliding movement of the roller skate.

Figure 2:
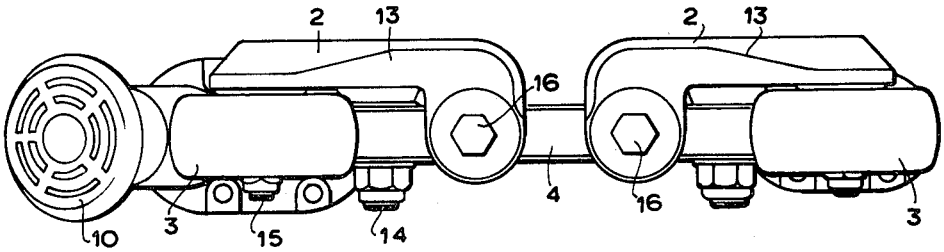
FIG. 2 is its base view.
Figure 3:
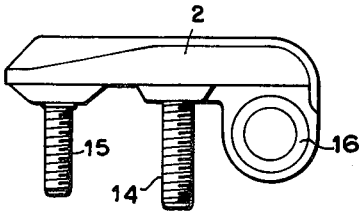
FIG. 3 is a base view of a suspension arm shown in FIG. 1.

As shown in FIGS. 2, 3, and 4, the suspension arm 2 is composed of a cushion supporting portion 12 including a bolt hole 11, a suspension arm body 13, a pivot bolt 14 for rotatably supporting the suspension arm body 13 and an axle bolt 15 for rotatably supporting a roller 3.

Through the hole 11 of the cushion supporting portion 12 is extended a cushion bolt 16 extending vertically through the bridge portion 4 and firmly secured through cushion rubbers 17, 18 to the base surface of the bridge portion 4 by means of a cushion nut 19.

The suspension arm body 13 connected to the cushion supporting portion 12 extends upwardly in parallel with the outside surface of the base portion 4 and then is inclined downwardly from a bent portion 20.

Figures 5A, 5B, 5C:
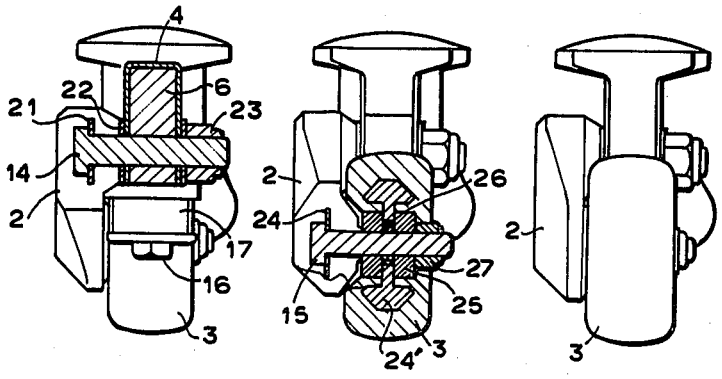
FIGS. 5A and 5B are end views of the roller skate shown in FIG. 1, partly shown in section.
FIG. 5C is an end view of the roller skate shown in FIG. 1.

As shown in FIGS. 1 to 4, a pivot bolt 14 is urged against an arm insert washer 21 and extends horizontally through the inside wall of the bent portion 20. As shown in FIG. 5A, the pivot bolt 14 together with the heel base portion 6 (or the toe base portion 5) are secured through a pivot washer 22 to the bridge portion 4 by means of a pivot nut 23. The suspension arm is made pivotable about the pivot bolt 14. In order to accommodate the slight pivoting movement of each suspension arm about the pivot bolt 14, the opening 32 in the bridge portion is flared, that is made larger at the bottom 33 than at the top 34, as shown in FIG. 4. It can be seen by reference to FIG. 4 that this flared construction of the opening 32 accommodates movement of the bolt 16 resulting from up and down movement of the skate roller 3 and the resultant pivoting of the suspension arm 2 about the pivot bolt 14.

As shown in FIGS. 3 and 5B, the suspension arm 2 is provided at its free end with an axle bolt 15 projected horizontally therefrom through an arm insert washer 24. A roller 3 is rotatably supported through a bearing cage 24', two bearings 25, 25, an intermediate ring 26 and an axle nut 27 by the axle bolt 15.

Figure 6:
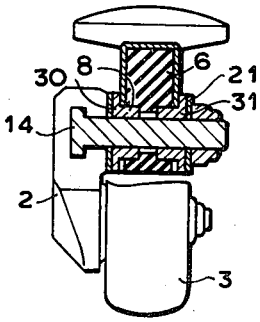
FIG. 6 is an end view of another embodiment of a two-wheeled roller skate according to the invention, partly shown in section.

FIG. 6 shows another embodiment of a two-wheeled roller skate according to the invention and corresponds to FIG. 5A. In the present embodiment, cushion rubbers 30, 31 are sandwiched between a pivot bolt 14 and a heel base portion 6. During gliding movement, the cushion rubbers 30, 31 function to cushion not only the forces acting in up and down directions but also the forces acting in left and right directions, when the roller 3 changes its gliding direction. As a result, when the roller skate changes its gliding direction, it can glide in a smooth manner as in an automobile's wheels.

The two-wheeled roller skate constructed as above described according to the invention can obtain the gliding movement and feeling similar to that of the ice skate, contrary to the four-wheeled roller skate which would not obtain such gliding movement and feeling.

In addition, the suspension arm 2 rotatably supporting the roller 3 extends in parallel with the outside surface of the base portion 1 and supports the roller 3 at its outside surface. As a result, as shown in FIGS. 2 and 5, any other constructional bodies are not present in the inside of the roller skate. Thus, when gliding the roller skate as a whole can be inclined inwardly without impeding the skater's gliding movement.

In addition, the suspension arm 2 is pivotable about the pivot bolt 14, so that it is possible to effectively alleviate the shock subjected to the roller 3 when it is gliding. In addition, the use of the suspension arm 2 inclined upwardly and then inclined downwardly from the bent portion 20 ensures a more effective shock alleviation ability.

As shown in FIG. 6, the suspension arm 2 is provided at its bent portion 20 (FIG. 1) with cushion rubbers 30, 31, so that it is possible to effectively alleviate the shock subjected to the roller 3 and to cause the roller 3 to rotate easily against the shock in the transverse direction produced when the roller skate changes its gliding movement, thereby causing the roller skate to change its gliding direction in a smooth manner.

In addition, the toe base portion 5 and heel base portion 6 of the base portion 1 are secured through the pivot bolt 14 to the two ends of the bridge portion 4, so that it is possible to exchange the bridge portion 4 in dependence with the change of the size of the skater's foot.

As shown in FIG. 5B, the roller 3 is journalled in the two bearings 25, 25, so that the roller 3 is mechanically strong and can withstand a sufficiently large shock and high load.

As stated hereinbefore, the two-wheeled roller skate according to the invention is capable of obtaining a gliding movement and feeling which is similar to that of the ice skate, of easily gliding even when the roller skate changes its gliding direction, of effectively alleviating the shock subjected to the roller skate when it is in gliding movement, and of providing a roller skate which is simple in construction and excellent in durability.

What is claimed is:

1. A two-wheeled roller skate comprising:

(a) a base plate having first and second vertical openings extending therethrough;

(b) a pair of suspension arms extending longitudinally of said base plate and generally parallel thereto;

(c) each of said suspension arms having a first end swingably connected to said base plate, a downwardly bent intermediate portion, and a second end, and having a skate roller connected to said second end:

(d) first bolt means extending through said first and second openings for swingably supporting said suspension arms;

(e) second bolt means extending horizontally through said bent portion of each suspension arm for pivotably supporting the suspension arms on said base plate;

(f) each of said first and second vertical openings in said base plate being larger at the bottom end thereof than at the top end thereof to accommodate pivoting movement of said suspension arms about said second bolt means; and (g) a toe base portion at one end of said base plate and a heel base portion at the other end of said base plate, said toe base portion being connected to said base plate by said second bolt means, and said heel base portion being connected to said base plate by said second bolt means.

* * * * *

UNITED STATES PATENT OFFICE

CERTIFICATE OF CORRECTION

Patent No. 4,392,659 Dated July 12, 1983

Inventor(s) Koichi Yoshimoto

It is certified that error appears in the above-identified patent and that said Letters Patent are hereby corrected as shown below:

Column 2, line 15, after the word "of" insert --each--.

Column 3, line 11, the word "would" should be --could--.

Signed and Sealed this

*Twenty-seventh* Day of *September 1983*

[SEAL]

*Attest:*

GERALD J. MOSSINGHOFF

*Attesting Officer* *Commissioner of Patents and Trademarks*